US009267735B2

(12) United States Patent
Funayama

(10) Patent No.: US 9,267,735 B2
(45) Date of Patent: Feb. 23, 2016

(54) DRYER

(75) Inventor: Hideki Funayama, Tsubame (JP)

(73) Assignees: TWINBIRD CORPORATION, Tsubame-Shi, Niigata (JP); KENFORD INDUSTRIAL COMPANY LIMITED, Hong Kong Special Administrative Region (CN)

( * ) Notice: Subject to any disclaimer, the term of this patent is extended or adjusted under 35 U.S.C. 154(b) by 324 days.

(21) Appl. No.: 14/007,154

(22) PCT Filed: Mar. 23, 2012

(86) PCT No.: PCT/JP2012/057607
§ 371 (c)(1),
(2), (4) Date: Sep. 24, 2013

(87) PCT Pub. No.: WO2012/128365
PCT Pub. Date: Sep. 27, 2012

(65) Prior Publication Data

US 2014/0013607 A1 Jan. 16, 2014

(30) Foreign Application Priority Data

Mar. 24, 2011 (JP) ..... 2011-066791

(51) Int. Cl.
*F26B 7/00* (2006.01)
*A45D 20/12* (2006.01)
*A45D 34/02* (2006.01)

(52) U.S. Cl.
CPC . *F26B 7/00* (2013.01); *A45D 20/12* (2013.01); *A45D 34/02* (2013.01); *A45D 2200/207* (2013.01)

(58) Field of Classification Search
CPC . A45D 20/12; A45D 2200/207; A45D 34/02; F26B 7/00; F26B 5/02
See application file for complete search history.

(56) References Cited

U.S. PATENT DOCUMENTS

2002/0056466 A1* 5/2002 Omura ..... A45D 20/50 132/272
2011/0209721 A1* 9/2011 Yahnker ..... A45D 20/12 132/271
2012/0062640 A1 3/2012 Uraki et al.

FOREIGN PATENT DOCUMENTS

JP 2005-205163 A 8/2005
JP 2007-029310 A 2/2007

(Continued)

OTHER PUBLICATIONS

International Search Report and Written Opinion dated May 15, 2012, which issued during the prosecution of International Patent Application No. PCT/JP2012/057607.

(Continued)

*Primary Examiner* — Jiping Lu
(74) *Attorney, Agent, or Firm* — Troutman Sanders LLP

(57) ABSTRACT

Provided is a dryer for drying hair or the like while evenly spraying a liquid such as a medical agent without causing the same to drip off. The dryer includes: a main body having an air outlet; and an atomizer. The atomizer includes: a container detachably attached to the main body; and an ultrasonic vibration unit close to the air outlet and atomizing the liquid in the container through an ultrasonic vibrator. Disposed around a downstream side of an outlet hole is an absorber with a passage communicated with the outlet hole that is on a downstream side of the ultrasonic vibrator in a casing composing the ultrasonic vibration unit. Formed on an inner wall of the outlet hole are thin grooves extended from the ultrasonic vibrator toward the absorber. Thus, droplets on the inner wall pass through the thin grooves before being absorbed by the absorber via capillary action.

9 Claims, 10 Drawing Sheets

(56) References Cited

FOREIGN PATENT DOCUMENTS

| | | | |
|---|---|---|---|
| JP | 2008-138892 | A | 6/2008 |
| JP | 2009-136305 | A | 6/2009 |
| JP | 2010-22561 | A | 2/2010 |
| JP | 4541987 | B2 | 9/2010 |
| WO | 2010/137491 | A1 | 12/2010 |

OTHER PUBLICATIONS

International Preliminary Report on Patentability under Chapter II dated May 8, 2013, which issued during the prosecution of International Patent Application No. PCT/JP2012/057607.

* cited by examiner

DRYER

CROSS-REFERENCE TO RELATED APPLICATIONS

This is a U.S. national phase application under 35 U.S.C. §371 of International Patent Application No. PCT/JP2012/057607, filed Mar. 23, 2012, and claims benefit of priority to Japanese Patent Application No. 2011-066791, filed March 24, 2011. The International Application was published on Sep. 27, 2012, as International Publication No. WO 2012/128365 under PCT Article 21(2). The entire contents of these applications are hereby incorporated by reference.

TECHNICAL FIELD

The present invention relates to a dryer for drying hair or the like.

BACKGROUND ART

Heretofore, as such a kind of dryer, there has been disclosed a dryer (e.g., Patent document 1) equipped with an aromatic substance container that is provided on a nozzle attached to an air outlet of a dryer main body. Particularly, an aromatic substance is stored in such aromatic substance container, and is then vaporized by a heat of the dryer such that the aromatic substance can be sent to hair along with a hot air.

PRIOR ART DOCUMENTS

Patent Documents

Patent document 1: Japanese patent No. 4541987

DISCLOSURE OF THE INVENTION

Problems to be Solved by the Invention

However, although the aforementioned dryer has been sufficiently practical when an amount of the aromatic substance is only large enough to perfume hair, the dryer has been unpractical when a medical agent (e.g, hair repairing agent) used in a relatively large amount is employed and stored in the aromatic substance container. Particularly, as for such a kind of medical agent, a component concentration thereof may change, or the agent itself may be altered due to a heat generated by a heater of the dryer. Therefore, this type of medical agent cannot be used in the conventional dryer and stored in the aromatic substance container thereof. Here, a medical agent that has turned to a gas due to a heat cannot easily adhere to hair in the first place, thus leaving a possibility that an effect(s) of the medical agent on hair may not be achieved as expected. For this reason, it is conceivable that a medical agent, without being heated, is first turned into a mist through atomization performed by an ultrasonic vibrator, followed by drying hair while spraying this mist thereon. However, a problem with such method is that the mist sprayed out may turn to droplets and drip off as a result of colliding with an inner wall of a mist outlet.

Therefore, it is an object of the present invention to solve the aforementioned problems and provide a dryer capable of drying hair or the like while evenly spraying a liquid such as a medical agent thereon in a hassle-free manner without causing the same to drip off.

Means to Solve the Problems

A first aspect of the present invention is a dryer having a dryer main body provided with an air outlet, comprising an atomizing device including a liquid container detachably attached to the dryer main body and an ultrasonic vibration unit provided in the vicinity of the air outlet of the dryer main body to atomize a liquid in the liquid container, the ultrasonic vibration unit having: an ultrasonic vibrator; a unit casing with an outlet hole formed on a downstream side of the ultrasonic vibrator; a liquid absorber equipped with an outlet passage that is communicated with the outlet hole of the unit casing and is formed around a downstream side of the outlet hole, the outlet hole and the outlet passage being coaxial with each other; and thin grooves that are formed on an inner wall of the outlet hole and extend from the ultrasonic vibrator to the liquid absorber, the thin grooves allowing droplets that have occurred on the inner wall of the outlet hole to pass therethrough and then flow into the liquid absorber through capillary action.

A second aspect of the present invention is based on the first aspect. According to a dryer of the second aspect, the dryer main body is provided with a handle and the thin grooves are disposed on an end portion of the inner wall of the outlet hole, the end portion being located on a side of the handle.

A third aspect of the present invention is based on the second aspect. According to a dryer of the third aspect, a plurality of the thin grooves are circumferentially arranged on a half of the outlet hole, the half being located on the side of the handle.

A fourth aspect of the present invention is based on the third aspect. According to a dryer of the fourth aspect, the plurality of the thin grooves are circumferentially arranged on an entire circumference of the outlet hole.

A fifth aspect of the present invention is based on the first aspect. According to a dryer of the fifth aspect, the thin grooves are formed in a location serving as a lower end portion of the inner wall of the outlet hole when used normally.

A sixth aspect of the present invention is based on any one of the first aspect through the fifth aspect. According to a dryer of the sixth aspect, an upstream end surface of the liquid absorber is positioned opposite to downstream ends of bottoms of the thin grooves.

A seventh aspect of the present invention is based on any one of the first aspect through the sixth aspect. According to a dryer of the seventh aspect, the outlet passage is isolated from an airflow passage inside the dryer.

An eighth aspect of the present invention is based on any one of the first aspect through the seventh aspect. According to a dryer of the eighth aspect, the outlet hole is formed wider on a side of the liquid absorber.

A ninth aspect of the present invention is based on any one of the first aspect through the eighth aspect. According to a dryer of the ninth aspect, the ultrasonic vibration unit is detachably attached to the dryer main body, and the liquid absorber is detachably attached to the dryer main body.

Effects of the Present Invention

An example of the dryer of the present invention is structured as above. For this reason, even if the droplets occur on the inner wall of the outlet hole of the unit casing, these droplets are caused to pass through the thin grooves by capillary action before flowing into the liquid absorber and being absorbed thereby. Thus, the droplets do not drip off the mist outlet.

Further, the handle is provided on the dryer main body; and the thin grooves are disposed on an end portion of the inner wall of the outlet hole that is located on the side of the handle.

For these reasons, the droplets that have occurred are guided to the thin grooves by gravity, thereby allowing the liquid absorber to absorb the droplets under normal use.

Furthermore, the plurality of the thin grooves are also circumferentially arranged on a half of the outlet hole that is located on the side of the handle. Therefore, even when the user is moving the dryer with a large magnitude to dry his/her hair, the droplets that have occurred are to be guided to any of the thin grooves by gravity, thus allowing the liquid absorber to absorb the droplets.

Furthermore, the plurality of the thin grooves are circumferentially arranged on the entire circumference of the outlet hole. Therefore, even when the dryer is being moved with a large magnitude to dry not only the hair of the user but the hair of others, the droplets that have occurred are to be guided to any of the thin grooves by gravity, thus allowing the liquid absorber to reliably absorb the droplets.

Furthermore, the thin grooves are formed in the location serving as the lower end portion of the inner wall of the outlet hole when used normally, thereby causing the droplets that have occurred to be guided to the thin grooves by gravity, thus allowing the liquid absorber to then absorb the droplets.

Furthermore, the upstream end surface of the liquid absorber is positioned opposite to the downstream ends of the bottoms of the thin grooves, thereby preventing the liquid flowing along the thin grooves from being turned into droplets again at the downstream ends of the thin grooves, thus allowing the liquid absorber to smoothly absorb the liquid.

Furthermore, the outlet passage is isolated from the airflow passage inside the dryer, thus allowing the droplets to be absorbed by the liquid absorber without causing the droplets that have occurred to be blown by the air of the dryer and drip off.

Furthermore, a region of the outlet hole that is closer to the liquid absorber is formed wider, and the outlet hole is also coaxial with the outlet passage. For these reasons, the droplets can be immediately guided to the thin grooves and then absorbed by the liquid absorber, regardless of where they may occur.

Here, due to the specification of the present invention, the outlet hole and the liquid absorber may be contaminated when used for a certain amount of time, thus resulting in a possibility that the expected effects may not be achieved. However, according to the dryer of the present invention, the ultrasonic vibration unit and the liquid absorber are respectively attached to the dryer main body in a detachable manner. Therefore, the outlet hole and the liquid absorber can be easily cleaned and replaced. Thus, the outlet hole and the liquid absorber can always be maintained clean.

MODE FOR CARRYING OUT THE INVENTION

Figure 1:
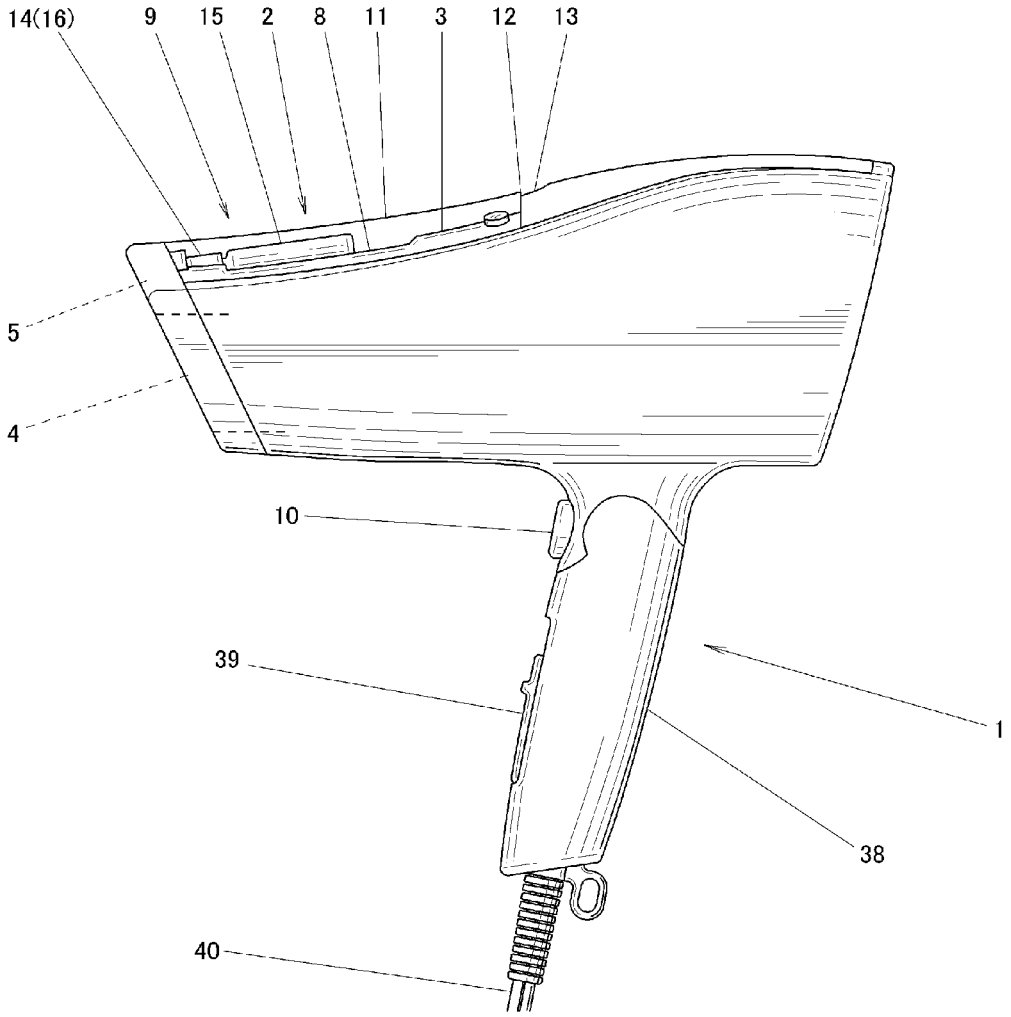
FIG. 1 is a front view of a dryer of a first embodiment of the present invention.
Figure 2:
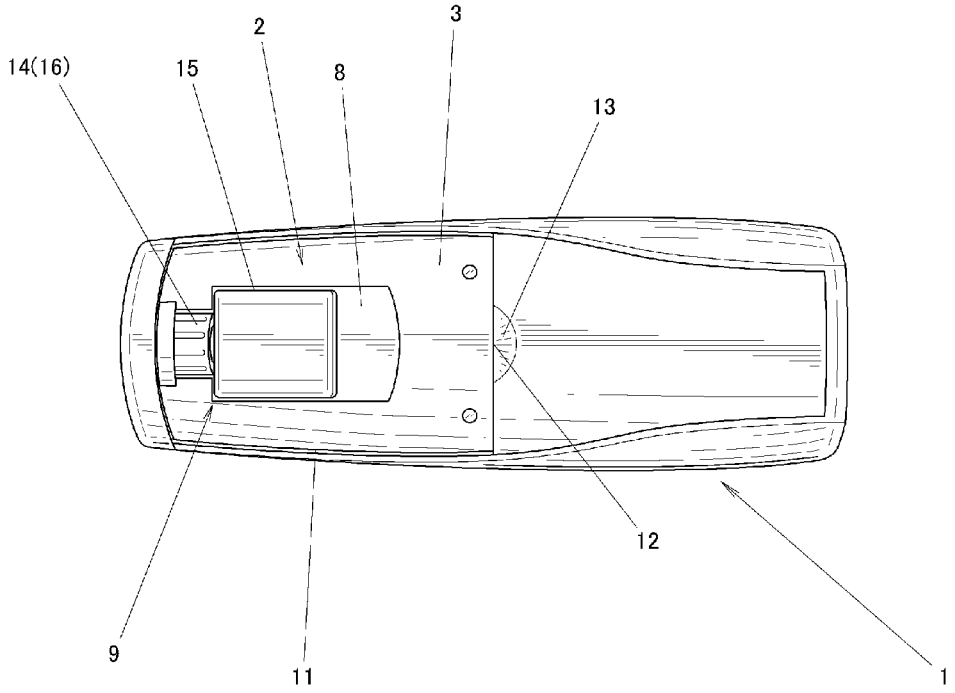
FIG. 2 is a plane view of the dryer of the first embodiment of the present invention.
Figure 3:
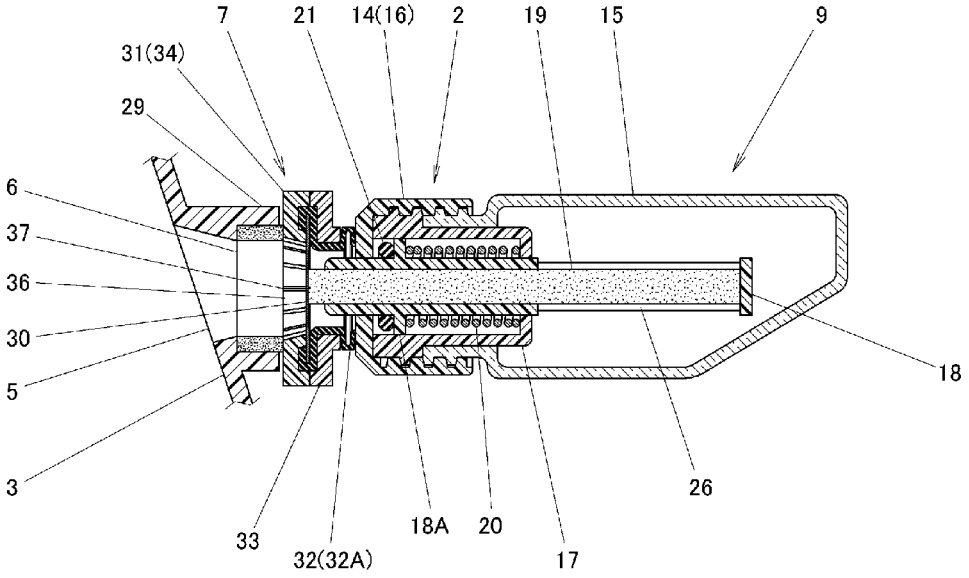
FIG. 3 is an explanatory diagram of an atomizing device of the first embodiment of the present invention.
Figure 4:
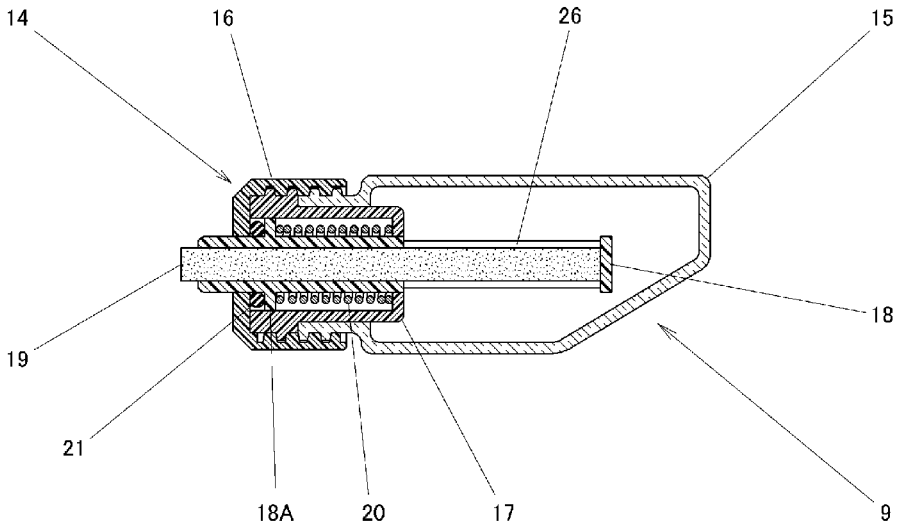
FIG. 4 is an enlarged cross-sectional view of a liquid container of the first embodiment of the present invention.
Figure 5:
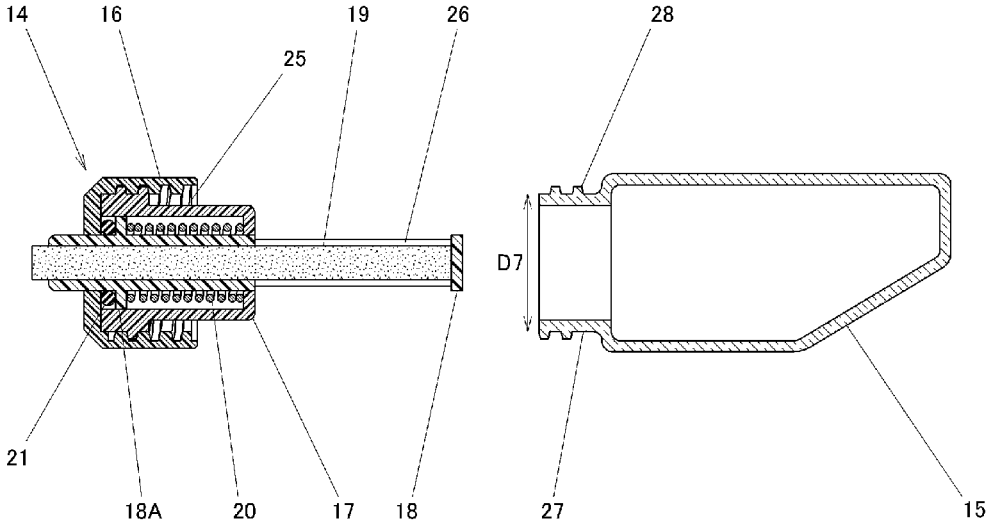
FIG. 5 is an enlarged cross-sectional view of the liquid container of the first embodiment of the present invention, the liquid container being in a state where a cap assembled body has been removed from a container main body.
Figure 6:
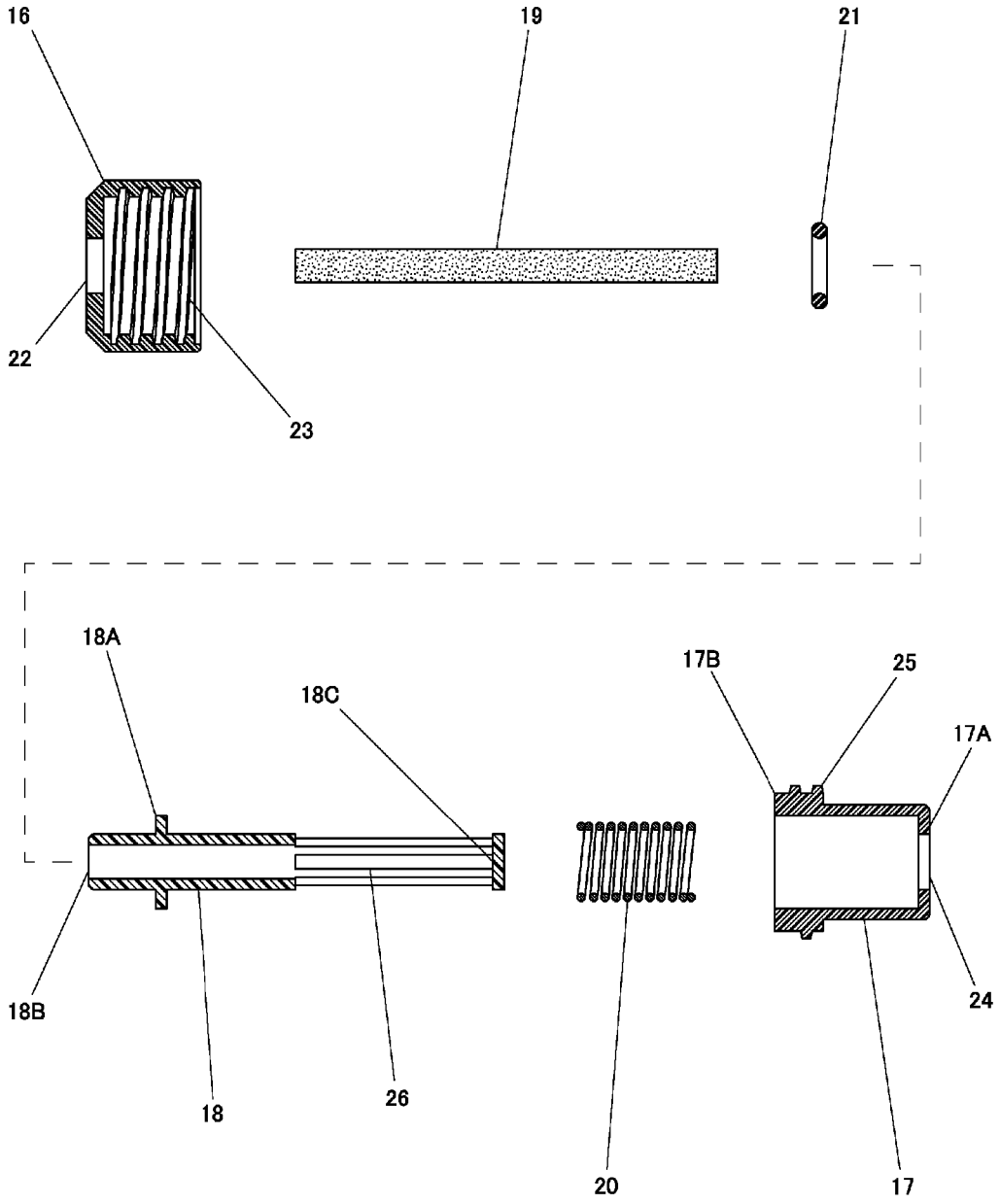
FIG. 6 is an exploded cross-sectional view of the cap assembled body of the first embodiment of the present invention.
Figure 7:
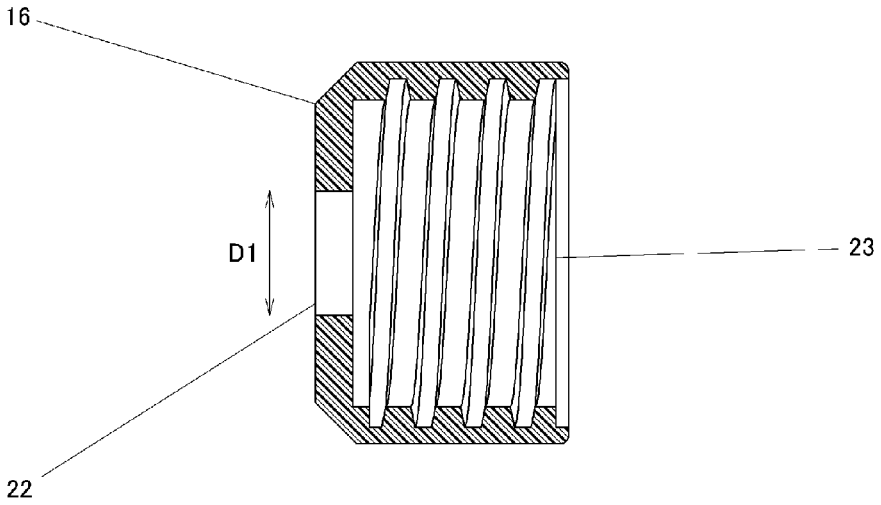
FIG. 7 is an enlarged cross-sectional view of a cap of the first embodiment of the present invention.
Figure 8:
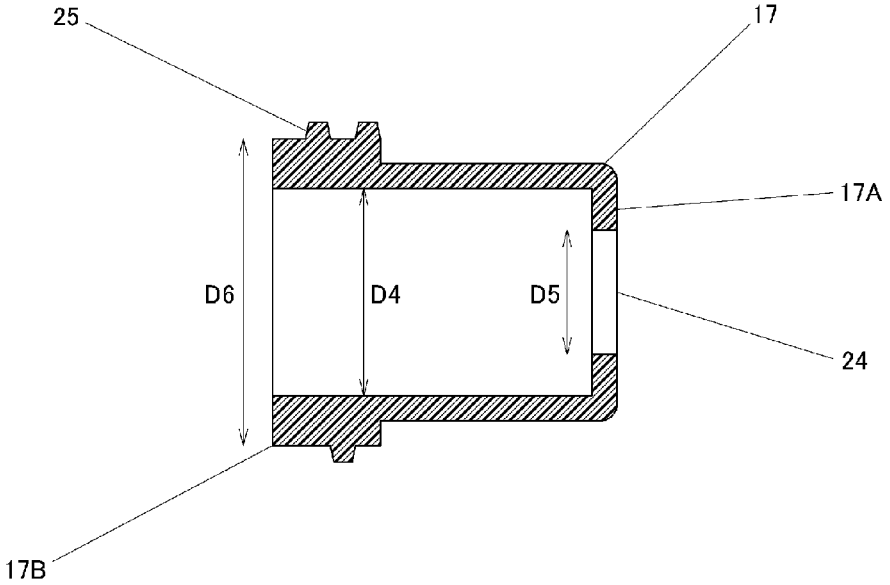
FIG. 8 is an enlarged cross-sectional view of a first holder of the first embodiment of the present invention.
Figure 9A:
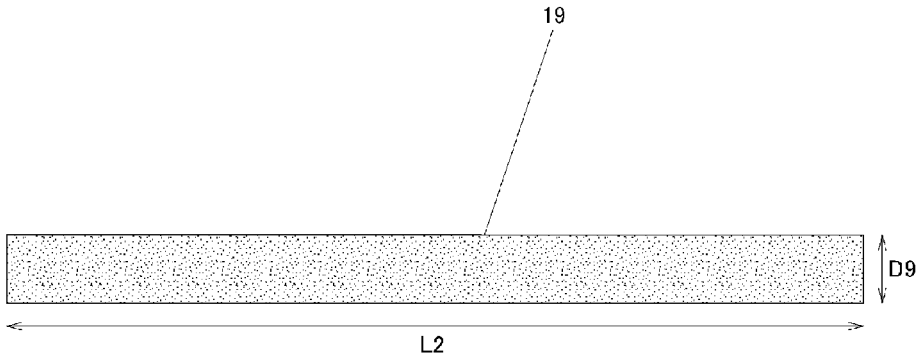
FIG. 9A is an enlarged cross-sectional view of a liquid guiding body of the first embodiment of the present invention.
Figure 9B:
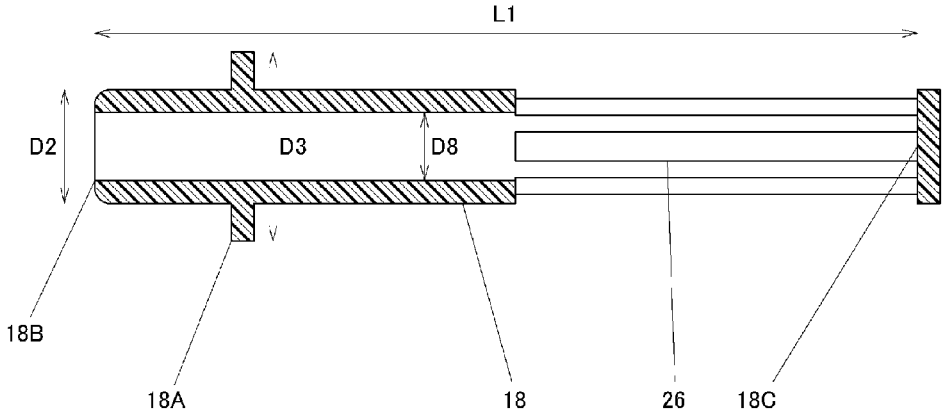
FIG. 9B is an enlarged cross-sectional view of a second holder of the first embodiment of the present invention.
Figure 10:
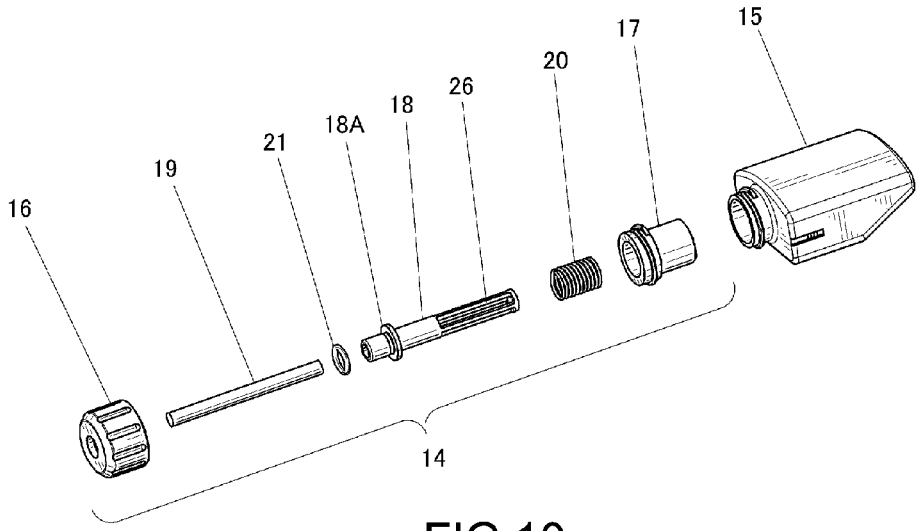
FIG. 10 is an exploded perspective view of the liquid container of the first embodiment of the present invention.
Figure 11:
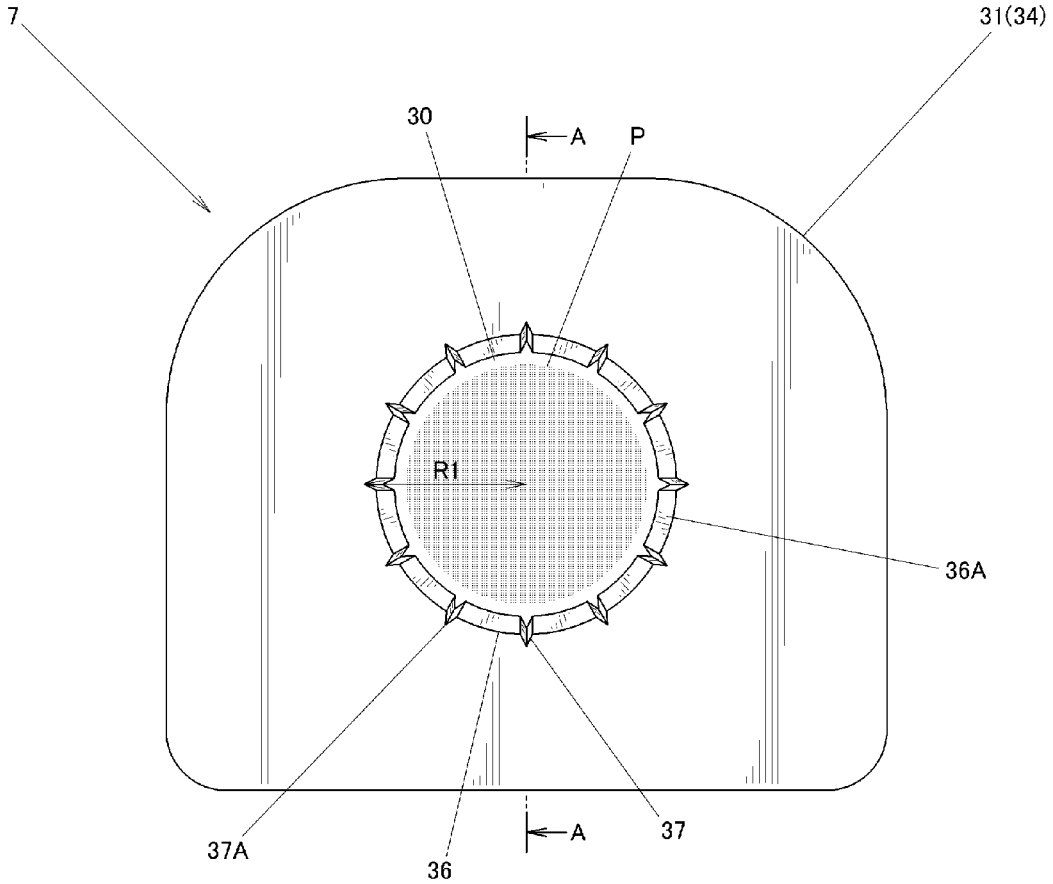
FIG. 11 is an external view of an ultrasonic vibration unit of the first embodiment of the present invention, the ultrasonic vibration unit being viewed from a downstream side thereof.
Figure 12:
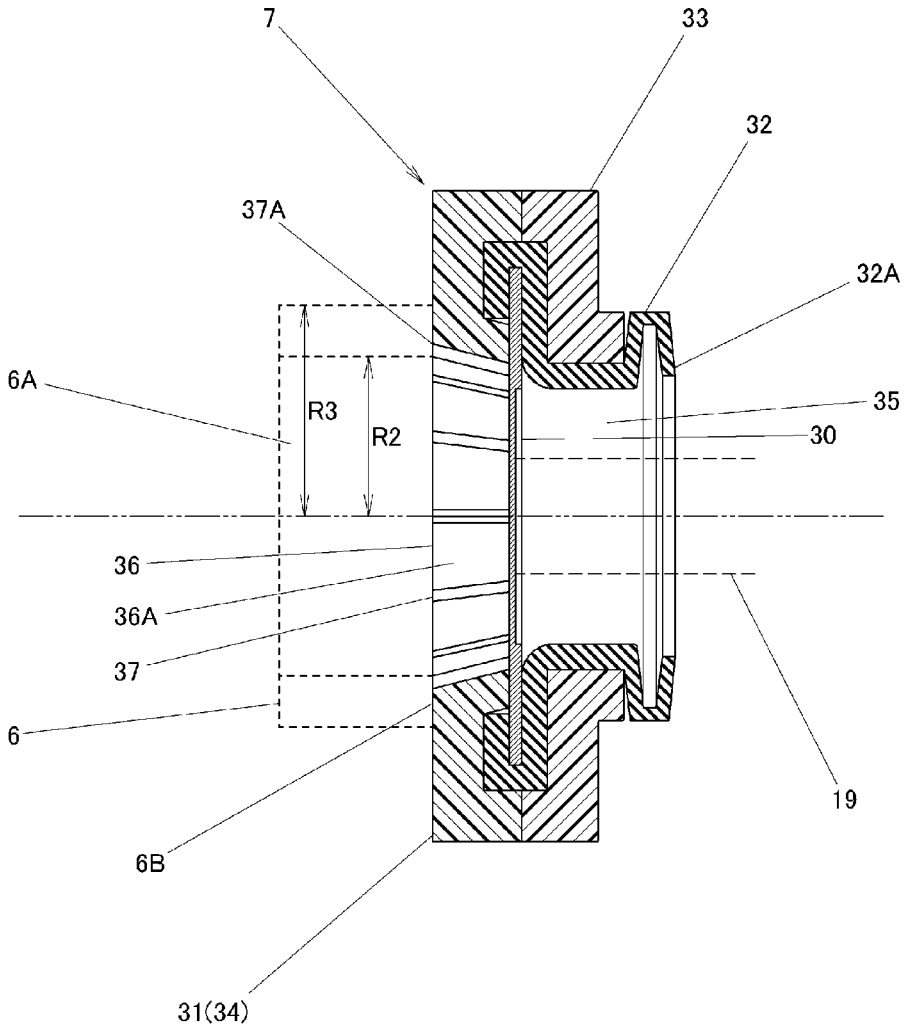
FIG. 12 is a cross-sectional view of the ultrasonic vibration unit of the first embodiment of the present invention, taken along a line A-A.

An embodiment of the present invention is described hereunder based on FIG. 1 through FIG. 12. In the following description, "liquid" refers not only to a medical agent or the like acting on hair, but also to water or the like. A numeral 1 denotes a dryer including an atomizing device 2. A dryer main body 3 of the dryer 1 is provided with an air outlet 4 and a mist outlet 5. Here, the mist outlet 5 is disposed above and independently from the air outlet 4. Further, provided inside the mist outlet 5 are a liquid absorber 6 and an ultrasonic vibration unit 7. Furthermore, a mounting recess 8 is formed on an upper portion of the dryer main body 3, which allows a liquid container 9 to be detachably attached thereto. Moreover, the dryer main body 3 is provided with an operating switch 10 for operating a control circuit (not shown) that operates the atomizing device 2. In short, the atomizing device 2 includes: the dryer main body 3 provided with the mist outlet 5 and the mounting recess 8; the liquid container 9 detachably attached to the mounting recess 8 of the dryer main body 3; the ultrasonic vibration unit 7 provided on the dryer main body 3; and the control circuit; and the operating switch 10. In addition, a cover 11 used to cover the liquid container 9 is detachably mounted on the dryer main body 3 over the mounting recess 8. Also, formed on the dryer main body 3 is a dent 13 allowing a finger(s) to be hooked on a finger-hooking portion 12 of the cover 11.

The liquid container 9 is now described in detail. The liquid container 9 includes a cap assembled body 14 and a container main body 15. Particularly, the cap assembled body 14 is configured by assembling together: a cap 16; a first holder 17; a second holder 18; a liquid guiding body 19; a compression coil spring 20; and an O-ring 21. The cap assembled body 14 is detachably attached to the container main body 15 with all of the aforementioned components being assembled together. Accordingly, even when the cap assembled body 14 has been removed from the container main body 15 to pour a liquid thereinto, each of the components of the cap assembled body 14 remains assembled, thus eliminating the need to assemble or disassemble the cap assembled body 14 every time a liquid is poured.

Formed in the cap 16 are a through hole 22 and a female screw portion 23. Here, an inner diameter D1 of the through hole 22 is formed slightly larger than an outer diameter D2 of the second holder 18, but smaller than an outer diameter D3 of a flange portion 18A formed on an outer surface of the second holder 18.

The first holder 17 is substantially formed into the shape of a hollow cylinder. Here, an inner diameter D4 of the first holder 17 is formed larger than an outer diameter D3 of the flange portion 18A. Further, an inward-facing flange portion 17A is formed on one end of the first holder 17, and a through hole 24 is formed in the central portion of the inward-facing flange portion 17A. Furthermore, a diameter-enlarged portion 17B is formed on the other end of the first holder 17, and a first male screw portion 25 is formed on the diameter-enlarged portion 17B. Particularly, an inner diameter D5 of the through hole 24 is formed substantially identical to the inner diameter D1 of the through hole 22, slightly larger than the outer diameter D2 of the second holder 18, and smaller than the outer diameter D3 of the flange portion 18A. Further, an outer diameter D6 of the diameter-enlarged portion 17B is substantially identical to an outer diameter D7 of a later described mouth portion 27 of the container main body 15. Furthermore, the first male screw portion 25 is so formed that it corresponds to the female screw portion 23. Therefore, the first holder 17 can be attached to the cap 16 by allowing the first male screw portion 25 and the female screw portion 23 to engage with each other.

The second holder 18 is substantially formed into the shape of a hollow cylinder whose first end is a closed end and whose second end is an open end. The second holder 18 is so configured that the liquid guiding body 19 can be held in an inner space thereof. Further, as described above, the flange portion 18A is formed on the outer surface of the second holder 18. Particularly, the flange portion 18A is so arranged on the outer surface of the second holder 18 that the flange portion 18A is formed closer to the second end of the second holder 18. Further, a plurality of liquid passage holes 26 are formed on a section of the second holder 18 that is located closer to the first end thereof. Here, an inner diameter D8 of the second holder 18 is identical to or slightly larger than an outer diameter D9 of the liquid guiding body 19. Moreover, a length L1 between an opening section 18B of the second holder 18 and the bottom section 18C thereof is shorter than a length L2 of the liquid guiding body 19. Therefore, even when the liquid guiding body 19 is to be inserted into the second holder 18 such that one end of the liquid guiding body 19 abuts against the bottom section 18C, the other end of this liquid guiding body 19 protrudes from the opening section 18B. Further, as described above, the outer diameter D2 of the second holder 18 is slightly smaller than the inner diameter D1 of the through hole 22 of the cap 16, and is also slightly smaller than the inner diameter D5 of the through hole 24 of the first holder 17. In addition, the outer diameter D3 of the flange portion 18A is larger than the inner diameter D1 of the through hole 22, and is also larger than the inner diameter D5 of the through hole 24. Therefore, the cap 16 and the first holder 17 can hold the second holder 18 in an axially movable manner as follows. That is, the female screw portion 23 of the cap 16 is to be engaged with the first male screw portion 25 of the first holder 17, while allowing the first end of the second holder 18 to protrude from the through hole 24 of the first holder 17 and the second end thereof to protrude from the through hole 22 of the cap 16.

The liquid guiding body 19 is substantially formed into a cylindrical shape, and is made of a material superior in liquid absorbency, liquid permeability and liquid retainability, such as felt or the like. Further, the compression coil spring 20 is so provided between the first holder 17 and the second holder 18 that while one end of the compression coil spring 20 abuts against the flange portion 17A of the first holder 17, the other end of the compression coil spring 20 abuts against the flange portion 18A of the second holder 18. Here, The O-ring 21 is disposed between an inner surface of the cap 16 and the flange portion 18A of the second holder 18.

The container main body 15 is made of a transparent or translucent material, and is formed into the shape a bottle having a mouth portion 27. Further, a second male screw portion 28 is formed on the mouth portion 27 of the container main body 15. Particularly, as for the second male screw portion 28, the pitch thereof and the heights of the tread ridges thereof are substantially identical to those of the first male screw portion 25. Further, as described above, the outer diameter D7 of the mouth portion 27 is substantially identical to the outer diameter D6 of the diameter-enlarged portion 17B. Therefore, the first male screw portion 25 and the second male screw portion 28 can be screwed together with the common female screw portion 23. In this way, as for the cap 16, since only one female screw portion 23 needs to be formed therein, the structure of the cap 16 is simple, thereby making it possible to manufacture the cap 16 at a lower cost.

The liquid absorber 6 is described hereunder in detail. As a result of stamping out a material superior in liquid absorbency and liquid retainability such as felt or the like with a die, the liquid absorber 6 is substantially formed into a cylindrical shape with an outlet passage 6A formed in a central portion thereof. Here, the liquid absorber 6 is held by a holding portion 29 formed in the mist outlet 5 of the dryer main body 3.

The ultrasonic vibration unit 7 is described hereunder in detail. This ultrasonic vibration unit 7 is detachably attached to the dryer main body 3. Particularly, the ultrasonic vibration unit 7 abuts against an edge of the liquid absorber 6 when attached to the dryer main body 3. Here, by removing the ultrasonic vibration unit 7 from the dryer main body 3, the liquid absorber 6 can be attached to or removed from the holding portion 29. The ultrasonic vibration unit 7 includes: a plate ultrasonic vibrator 30; a unit casing 31; and a sealing member 32. A number of minute through holes P are formed in a central portion of the ultrasonic vibrator 30. Moreover, an outer circumferential section of the ultrasonic vibrator 30 is held by the unit casing 31 and the sealing member 32. The unit casing 31 includes a first half body 33 and a second half body 34. Particularly, an insertion hole 35 is formed on the first half body 33. The central portion of the ultrasonic vibrator 30 is exposed from the insertion hole 35 to the mounting recess 8, and an abutting portion 32A of the sealing member 32 is arranged on an open end of the insertion hole 35. The abutting portion 32A abuts against the cap 16 of the liquid container 9, when the liquid container 9 has been attached to the mounting recess 8. Further, when the liquid container 9 is attached to the mounting recess 8, a second end of the liquid guiding body 19 abuts against a first surface of the ultrasonic vibrator 30. Meanwhile, an outlet hole 36 is formed on the second half body 34. A liquid mist produced by the ultrasonic vibrator 30 is allowed to pass through the outlet hole 36 and blow out therefrom. That is, the liquid absorber 6 is disposed on a downstream side of the outlet hole 36 with respect to the flow of the aforementioned mist. In addition, the outlet hole 36 is formed wider on a side of the liquid absorber 6. Further, the outlet hole 36 is formed so as to be coaxial with the outlet passage 6A of the liquid absorber 6. Furthermore, on an inner wall 36A of the outlet hole 36, a plurality of thin grooves 37 are formed over the entire circumference thereof in a manner such that the thin grooves 37 extend toward the liquid absorber 6 from a second surface side of the ultrasonic vibrator 30. In the present embodiment, 12 thin grooves 37 are formed at regular-angle intervals over the entire circumference of the inner wall 36A of the outlet hole 36. However, the number of the thin grooves 37 can, in fact, be set as appropriate. Further, a distance R1 ranging from the center of the outlet hole 36 at a downstream end to a bottom 37A of each thin groove 37, is larger than a radius R2 of the outlet passage 6A of the liquid absorber 6, but is smaller than a radius R3 of an outer circumferential surface of the liquid absorber 6. In other words, at the downstream end of the outlet hole 36, the bottom 37A of each thin groove 37 is opposed to an upstream end surface 6B of the liquid absorber 6.

In addition, a numeral 38 denotes a handle foldably attached to the dryer main body 3. A numeral 39 denotes a main operating switch disposed on the handle 38, and a numeral 40 denotes a power-supply cord.

Functions of the present embodiment are described hereunder. In the beginning, a user puts his/her finger(s) into the dent 13 of the dryer main body 3 so as to remove the cover 11 by hooking the finger(s) on the finger-hooking portion 12 of the cover 11. Then, the liquid container 9 is to be removed from the mounting recess 8 of the dryer main body 3.

Further, the cap assembled body 14 is to be removed from the liquid container 9, followed by pouring a liquid into the container main body 15 from the mouth portion 27 of such container main body 15 from which the cap assembled body 14 has been removed. The cap assembled body 14 is then reattached to the mouth portion 27 of container main body 15 filled with the liquid. Under such condition, the second holder 18 and the liquid guiding body 19 which compose the cap assembled body 14, are biased outward in an axial direction by the compression coil spring 20, thus protruding to the outermost side. At that time, the second holder 18 moves toward the cap 16 as a result of being pushed by the compression coil spring 20, thereby causing the O-ring 21 to be sandwiched between and thus tightly abut against the inner surface of the cap 16 and the flange portion 18A. In this way, water in the liquid container 9 can be prevented from leaking from a gap between an inner surface of the first holder 17 and the flange portion 18A, and then through a gap between the through hole 22 and the second holder 18. In fact, the liquid in the liquid container 9 is to be absorbed by and then retained in the liquid guiding body 19, via the liquid passage holes 26 of the second holder 18. Thus, the liquid in the liquid container 9 can also be prevented from leaking from the liquid guiding body 19. Further, the second holder 18 and the liquid guiding body 19 can be pushed inward in the axial direction against a biasing force of the compression coil spring 20. That is, the second holder 18 and the liquid guiding body 19 can be retractable with respect to the container 15.

Then, the liquid container 9 filled with the liquid in such manner is reattached to the mounting recess 8 of the dryer main body 3. At this moment, while the second end of the liquid guiding body 19 abuts against a first surface side of the ultrasonic vibrator 30, the liquid guiding body 19 and the second holder 18 are to be pushed into the liquid container 9 against the biasing force of the compression coil spring 20. Therefore, the liquid guiding body 19 is pressed against the ultrasonic vibrator 30 due to the biasing force of the compression coil spring 20. Particularly, since the liquid guiding body 19 is pressed against the ultrasonic vibrator 30, the liquid retained by the liquid guiding body 19 can flow into the plurality of the minute through holes P formed on the ultrasonic vibrator 30 and be retained thereby. Here, the abutting portion 32A of the sealing member 32 comes into contact with an outer surface of the cap 16 of the liquid container 9. As a result, the ultrasonic vibrator 30 and the liquid guiding body 19 are to be surrounded by the sealing member 32 and the outer surface of the cap 16. Then, the cover 11 is reattached to the dryer main body 3 to cover the liquid container 9.

A power plug (not shown) disposed on the tip of the power-supply cord 40 is inserted into an AC power outlet (not shown) after raising the handle 38. Next, by operating the main operating switch 39, hot or cold air blows out of the air outlet 4. Then, the air outlet 4 is directed to the user's head by gripping the handle 38. In this way, hot or cold air can be blown to the user's hair, thus allowing the user to dry or set his/her hair.

In order to spray a mist (atomized liquid) to the hair, the user needs to operate the operating switch 10 such that the ultrasonic vibrator 30 can vibrate by means of a control circuit (not shown). As the ultrasonic vibrator 30 vibrates, the liquid held by the plurality of the minute through holes P formed on the ultrasonic vibrator 30 is atomized on a second surface side thereof. The liquid thus atomized is then blown out of the mist outlet 5 through the outlet hole 36 formed in the unit casing 31 and through the outlet passage 6A formed in the liquid absorber 6. Meanwhile, as described above, since the second end of the liquid guiding body 19 is pressed against the first surface side of the ultrasonic vibrator 30 due to the biasing force of the compression coil spring 20, the first surface side of the ultrasonic vibrator 30 and the second end of the liquid guiding body 19 can favorably stay in contact with each other. Therefore, the liquid retained in the liquid guiding body 19 can be reliably transferred to the ultrasonic vibrator 30 and then favorably atomized thereby. Then, in order to supplement the liquid that has been atomized, the liquid retained by the second end of the liquid guiding body 19 moves to the plurality of the minute through holes P of the ultrasonic vibrator 30; the liquid retained by a first end of the liquid guiding body 19 moves to the second end thereof; and the liquid in the liquid container 9 moves to the first end of the liquid guiding body 19 through the liquid passage holes 26 of the second holder 18. In this manner, the liquid inside the liquid container 9 is sequentially atomized by the ultrasonic vibrator 30. The mist blown out of the mist outlet 5 joins the airflow blown out of the air outlet 4, thus being sprayed onto the hair along with the aforementioned airflow. The mist sprayed onto the hair serves to repair damages of or luster the hair.

As described above, the liquid container 9 is disposed on the mounting recess 8 provided on the dryer main body 3, but is actually isolated from an airflow passage of the dryer 1. Therefore, the liquid inside the liquid container 9 is not heated to a high temperature by a heater (not shown) of the dryer 1. Thus, the liquid in the liquid container 9, prior to atomization, is hardly affected by the heat of the heater. At the same time, as described above, the atomization of the liquid is effected by the ultrasonic vibrator 30, and the heat generated by the heater hereby does not contribute to the atomization of the liquid. Here, the mist blown out of the mist outlet 5 can be affected by heat, when the airflow from the air outlet 4 is hot. However, the impact of the heat is minimized, since the mist is affected by heat for only a short period of time starting from the moment when it is blown out of the mist outlet 5 to the moment when it reaches the hair.

Meanwhile, part of the liquid retained in the liquid guiding body 19 may be atomized and hereby turned into a mist around the corresponding liquid guiding body 19. However, as described above, the periphery of the ultrasonic vibrator 30 is surrounded by the sealing member 32, and the tip of the sealing member 32 is in contact with the cap 16 when the liquid container 9 is mounted on the mounting recess 8.

Hence, the mist does not leak from a space defined by the ultrasonic vibrator 30, the sealing member 32 and the cap 16 to a space defined by the mounting recess 8 and the cover 11. Further, part of the mist passes from the aforementioned space through the through holes P of the ultrasonic vibrator 30, before being blown out of the mist outlet 5. Furthermore, part of the mist, after being absorbed by the liquid guiding body 19, again passes through the through holes P of the ultrasonic vibrator 30, before being atomized by the corresponding ultrasonic vibrator 30 and then blown out of the mist outlet 5.

In some cases, the mist produced by the ultrasonic vibrator 30 may be turned into numerous fine droplets, as a result of colliding with the inner wall 36A of the outlet hole 36. When these fine droplets have grown into large droplets through aggregation, they may drip off the mist outlet 5 and wet the surroundings. However, as described above, the plurality of the thin grooves 37 are formed on the inner wall 36A of the outlet hole 36, thereby allowing the droplets to be led to the thin grooves 37 and absorbed by the liquid absorber 6 through capillary action. In this way, a liquid such as a medical agent or the like can be retained by the liquid absorber 6. Thus, the liquid that has been turned into droplets can be prevented from dripping off the mist outlet 5. Further, since the plurality of the thin grooves 37 are formed over the entire circumference of the inner wall 36A of the outlet hole 36 at regular-angle intervals, the droplets do not drip off the mist outlet 5 regardless of how the dryer 1 is positioned (e.g. the handle 38 facing upward) when the user uses the dryer to dry not only his/her hair, but the hair of others. Moreover, as described above, at the downstream end of the outlet hole 36, the bottoms 37A of the thin grooves 37 are positioned opposite to the upstream end surface 6B of the liquid absorber 6. Hence, the droplets led to the thin grooves 37 can be reliably absorbed by the liquid absorber 6 without being collected at the downstream ends of the thin grooves 37. Here, volatile components in the liquid absorbed by the liquid absorber 6, dry naturally. Furthermore, the liquid absorber 6 can be replaced by removing the ultrasonic vibration unit 7 from the dryer main body 3, in case that the liquid absorber 6 has become tainted or absorbed a significant amount of non-volatile components due to a prolonged use.

To summarize, the present invention provides the dryer 1 including the dryer main body 3 equipped with the air outlet 4. The dryer 1 further includes the atomizing device 2 serving to atomize a liquid such as a medical agent or the like in the liquid container 9 through the ultrasonic vibration unit 7. Particularly, the ultrasonic vibration unit 7 includes: the ultrasonic vibrator 30; and the unit casing 31 having the outlet hole 36 that is formed on the downstream side of the ultrasonic vibrator 30. Further, the liquid container 9 is detachably attached to the dryer main body 3; the ultrasonic vibration unit 7 is disposed in the vicinity of the air outlet 4 of the dryer main body 3; and the liquid absorber 6 having the outlet passage 6A communicated with the outlet hole 36 is provided around the downstream side of the outlet hole 36, the outlet hole 36 and the outlet passage 6A being coaxial with each other. Furthermore, formed on the inner wall 36A of the outlet hole 36 are the thin grooves 37 extending from the ultrasonic vibrator 30 toward the liquid absorber 6, the thin grooves 37 allowing the droplets that have occurred on the inner wall 36A of the outlet hole 36 to pass therethrough and then flow into the liquid absorber 6 through capillary action. For this reason, even if the droplets occur and then grow on the inner wall 36A of the outlet hole 36, these droplets are caused to pass through the thin grooves 37 by capillary action before flowing into the liquid absorber 6 and being absorbed thereby, thus being prevented from dripping off the mist outlet 5.

Further, in the present invention, the handle 38 is provided on the dryer main body 3; and the thin grooves 37 are disposed on an end portion of the inner wall 36A of the outlet hole 36 that is located on the side of the handle 38, such end portion being a lower end portion when used normally. For these reasons, the droplets that have occurred are guided to the thin grooves 37 by gravity, thereby allowing the liquid absorber 6 to absorb the droplets such that the droplets are then prevented from dripping under normal use.

Furthermore, in the present invention, the plurality of the thin grooves 37 are also circumferentially arranged on a half of the inner wall 36A of the outlet hole 36 that is located on the side of the handle 38. Therefore, even when the user is moving the dryer 1 with a large magnitude to dry his/her hair, the droplets that have occurred are to be guided to any of the thin grooves 37 by gravity, thus allowing the liquid absorber 6 to absorb the droplets.

Furthermore, in the present invention, the plurality of the thin grooves 37 are circumferentially arranged on the entire circumference of the inner wall 36A of the outlet hole 36. Therefore, even when the dryer 1 is being moved with a large magnitude to dry not only the hair of the user but the hair of others, the droplets that have occurred are to be guided to any of the thin grooves 37 by gravity, thus allowing the liquid absorber 6 to reliably absorb the droplets.

Furthermore, in the present invention, the upstream end surface 6B of the liquid absorber 6 is positioned opposite to the downstream ends of the bottoms 37A of the thin grooves 37, thereby preventing the liquid flowing along the thin grooves 37 from being turned into droplets again at the downstream ends of the thin grooves 37, thus allowing the liquid absorber 6 to smoothly absorb the liquid.

Furthermore, the outlet passage 6A is isolated from the airflow passage inside the dryer 1, thus allowing the droplets to be absorbed by the liquid absorber 6 without causing the droplets that have occurred to be blown by the air of the dryer 1 and drip off.

Furthermore, the outlet hole 36 is formed wider on the side of the liquid absorber 6. For these reasons, the droplets can be immediately guided to the thin grooves 37 and then absorbed by the liquid absorber 6, regardless of where they may occur.

Here, due to the specification of the present invention, the outlet hole 36 and the liquid absorber 6 may be contaminated when used for a certain amount of time, thus resulting in a possibility that the expected effects may not be achieved. However, according to the dryer 1 of the present invention, the ultrasonic vibration unit 7 and the liquid absorber 6 are respectively attached to the dryer main body 3 in a detachable manner. Therefore, the outlet hole 36 and the liquid absorber 6 can be easily cleaned and replaced. Thus, the outlet hole 36 and the liquid absorber 6 can always be maintained clean.

Figure 13:
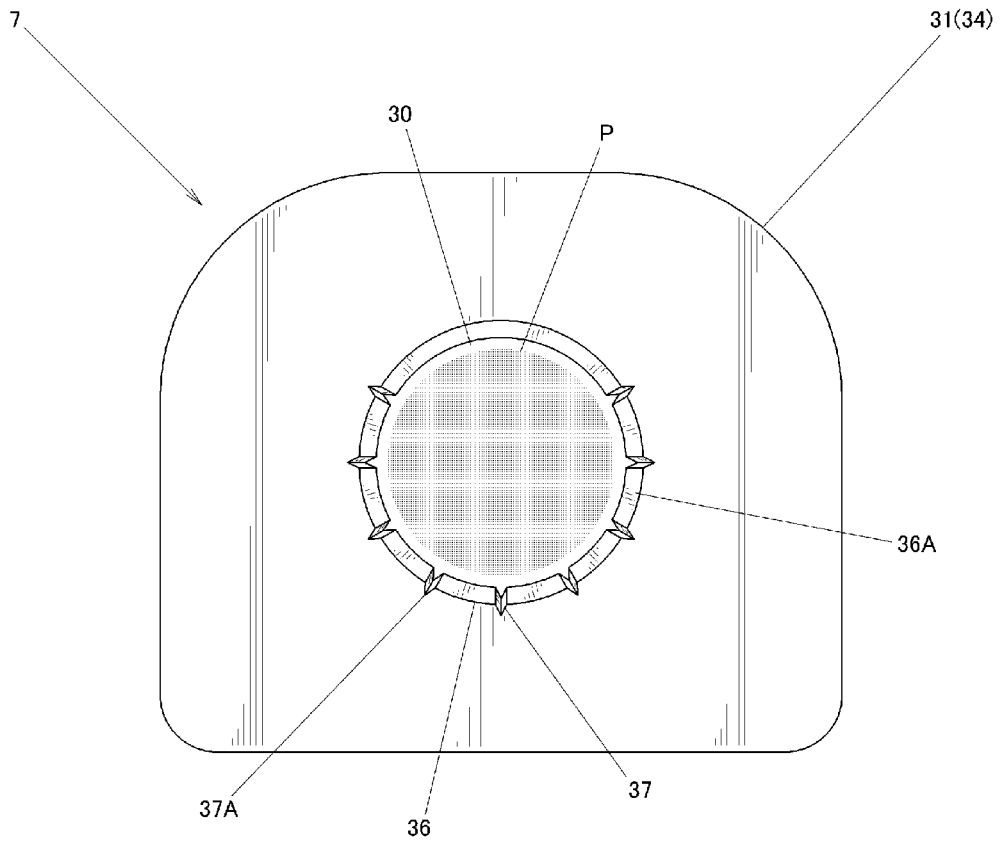
FIG. 13 is an external view of an ultrasonic vibration unit of a dryer of a second embodiment of the present invention, the ultrasonic vibration unit being viewed from a downstream side thereof.

In addition, it should be noted that the present invention is not limited to the above embodiment. In fact, various modified embodiments are possible within the scope of the present invention. For example, in the above embodiment, the plurality of the thin grooves are formed on the entire circumference of the inner wall of the outlet hole in consideration of the fact that the dryer may be used not only by the user but also against others. However, when the dryer is only being used by the user to dry his/her own hair, it is seldom held in a manner such that the handle points upward. Thus, as shown in FIG. 13, it is often sufficient to simply dispose the thin grooves in a range covering a lower half portion of the inner wall of the outlet hole and a periphery thereof. Further, if the dryer is that of a stationary type, an upper and a lower side thereof are fixed.

Figure 14:
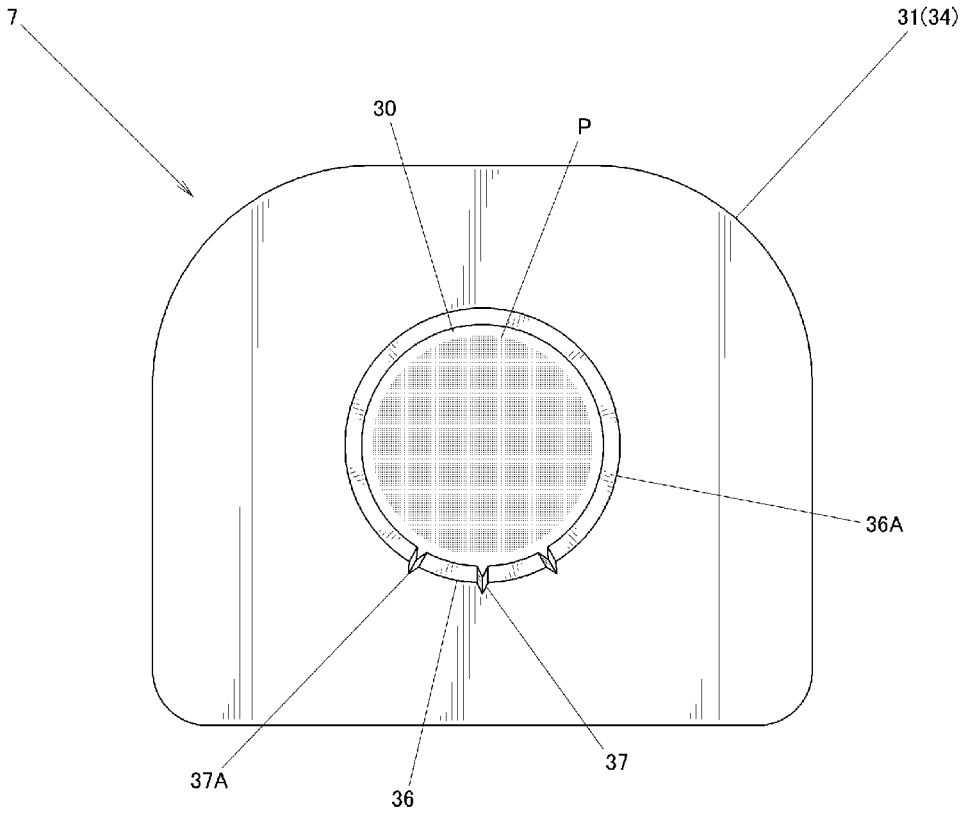
FIG. 14 is an external view of an ultrasonic vibration unit of a dryer of a third embodiment of the present invention, the ultrasonic vibration unit being viewed from a downstream side thereof.

Therefore, in such case, as shown in FIG. 14, it is sufficient to form the thin grooves on a lower portion of the inner wall of the outlet hole. Further, the dryer of the present invention may be used not only as a hair dryer, but also as a dryer for drying other parts of human body (for example, a drying target may be a hand, and the liquid supplied as a mist may be a beauty lotion).

The invention claimed is:

1. A dryer having a dryer main body provided with an air outlet, comprising:

an atomizing device including a liquid container detachably attached to said dryer main body and an ultrasonic vibration unit provided in the vicinity of said air outlet of said dryer main body to atomize a liquid in said liquid container, said ultrasonic vibration unit having:

an ultrasonic vibrator;

a unit casing with an outlet hole formed on a downstream side of said ultrasonic vibrator;

a liquid absorber equipped with an outlet passage that is communicated with said outlet hole of said unit casing and is formed around a downstream side of said outlet hole, said outlet hole and said outlet passage being coaxial with each other; and thin grooves that are formed on an inner wall of said outlet hole and extend from said ultrasonic vibrator to said liquid absorber, said thin grooves allowing droplets that have occurred on said inner wall of said outlet hole to pass therethrough and then flow into said liquid absorber through capillary action.

2. The dryer according to claim 1, wherein said dryer main body is provided with a handle and said thin grooves are disposed on an end portion of said inner wall of said outlet hole, said end portion being located on a side of said handle.

3. The dryer according to claim 2, wherein a plurality of said thin grooves are circumferentially arranged on a half of said outlet hole, said half being located on the side of said handle.

4. The dryer according to claim 3, wherein the plurality of said thin grooves are circumferentially arranged on an entire circumference of said outlet hole.

5. The dryer according to claim 1, wherein said thin grooves are formed in a location serving as a lower end portion of said inner wall of said outlet hole when used normally.

6. The dryer according to claim 1, wherein an upstream end surface of said liquid absorber is positioned opposite to downstream ends of bottoms of said thin grooves.

7. The dryer according to claim 1, wherein said outlet passage is isolated from an airflow passage inside said dryer.

8. The dryer according to claim 1, wherein said outlet hole is formed wider on a side of said liquid absorber.

9. The dryer according to claim 1, wherein said ultrasonic vibration unit is detachably attached to said dryer main body, and said liquid absorber is detachably attached to said dryer main body.

* * * * *